US006880481B2

(12) United States Patent
Dunn et al.

(10) Patent No.: US 6,880,481 B2
(45) Date of Patent: Apr. 19, 2005

(54) INFLATABLE KAYAK WITH MULTI-POSITION FOOTRESTS

(75) Inventors: Patricia A. Dunn, Wichita, KS (US); Shin Tsai Wu, Taipei (TW); Andrew T. Metzger, Belle Plaine, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 10/604,539

(22) Filed: Jul. 29, 2003

(65) Prior Publication Data

US 2005/0022715 A1 Feb. 3, 2005

(51) Int. Cl.[7] ..... B63B 35/00
(52) U.S. Cl. ..... 114/347; 114/345
(58) Field of Search ..... 114/343, 345, 114/347

(56) References Cited

U.S. PATENT DOCUMENTS

| | | | | | |
|---|---|---|---|---|---|
| 1,372,528 | A | | 3/1921 | Marcovsky | 114/347 |
| 2,338,976 | A | | 1/1944 | Schutte | 114/354 |
| 2,642,590 | A | | 6/1953 | Hermann | 114/345 |
| 2,873,459 | A | | 2/1959 | Marz | 114/347 |
| 2,962,732 | A | | 12/1960 | Marz | 114/347 |
| 2,999,253 | A | | 9/1961 | Lewis | 114/347 |
| 4,031,580 | A | | 6/1977 | Neumann et al. | 114/347 |
| 4,057,865 | A | | 11/1977 | Trautwein | 114/347 |
| 4,589,365 | A | * | 5/1986 | Masters | 114/347 |
| 4,807,554 | A | | 2/1989 | Chi-Hung | 114/345 |
| 4,838,196 | A | | 6/1989 | Ingram | 114/347 |
| 5,299,524 | A | | 4/1994 | Szilagyi | 114/345 |
| 5,325,806 | A | | 7/1994 | Lee | 114/345 |
| 5,417,179 | A | * | 5/1995 | Niemier et al. | 114/347 |
| 5,493,982 | A | * | 2/1996 | Carpenter et al. | 114/347 |
| 5,507,244 | A | | 4/1996 | Lee | 114/345 |
| 5,671,694 | A | | 9/1997 | Schoettle | 114/347 |
| 5,729,840 | A | | 3/1998 | Wu | 4/588 |
| D394,630 | S | * | 5/1998 | Lincoln | D12/302 |
| D400,843 | S | * | 11/1998 | Niemier | D12/302 |
| 5,915,327 | A | | 6/1999 | Elvestad | 114/347 |
| 5,921,197 | A | | 7/1999 | Wagner | 114/347 |
| 5,964,177 | A | * | 10/1999 | Niemier | 114/347 |
| 6,065,421 | A | | 5/2000 | Haller et al. | 114/347 |
| D427,561 | S | | 7/2000 | Haller et al. | D12/302 |
| 6,152,063 | A | * | 11/2000 | Niemier | 114/347 |
| 6,155,899 | A | | 12/2000 | Boddy | 441/130 |
| 6,171,161 | B1 | | 1/2001 | Peterson | 441/130 |
| 6,178,912 | B1 | * | 1/2001 | Niemier | 114/347 |
| 6,223,678 | B1 | | 5/2001 | Haller et al. | 114/347 |
| 6,263,827 | B1 | | 7/2001 | Szigeti | 114/354 |
| 6,443,089 | B1 | * | 9/2002 | Goucher et al. | 114/347 |
| 6,568,012 | B1 | | 5/2003 | Michaelis et al. | 5/706 |

* cited by examiner

*Primary Examiner*—Lars A. Olson
(74) *Attorney, Agent, or Firm*—Leydig, Voit & Mayer, Ltd

(57) ABSTRACT

An inflatable kayak having a multi-position footrest spaced from the seat of the kayak is disclosed. The multi-position footrest allows the kayak to accommodate operators of various sizes. The kayak may also include front and rear recessed cargo compartments which allow a significant quantity of cargo to be carried on the kayak without significantly raising the center of gravity of the kayak and without causing the kayak to become unbalanced.

46 Claims, 5 Drawing Sheets

INFLATABLE KAYAK WITH MULTI-POSITION FOOTRESTS

BACKGROUND OF INVENTION

1. Field of the Invention

The present invention relates generally to inflatable watercrafts, and more particularly, to an inflatable sit-on-top kayak having a multi-position footrest.

2. Technical Background

Kayaks, for centuries a mode of transport, are also popular for recreational purposes. Traditional kayaks had a substantially rigid construction, making it difficult to portage the kayak a significant distance over rugged terrain or to load and carry the kayak atop motorized vehicles. Because many preferred sites for kayaking are located in remote regions that are inaccessible to motorized vehicles, the traditional construction of kayaks has proven to be disadvantageous for today's recreationist.

In response to these disadvantages of traditional rigid kayaks, inflatable kayaks have been developed. Easily deflated and folded, inflatable kayaks offer lightweight and compact carrying ability, as well as ease of use when inflated at water's edge. One disadvantage of conventional inflatable kayaks, however, is an inability to accommodate users of varying sizes. In particular, it is important for the operator of a sit-on-top inflatable kayak to be able to brace his/her feet against a footrest to maintain balance and position while paddling and during maneuvers in the water. However, traditional inflatable kayaks either do not provide a footrest at all, or provide only a single non-adjustable footrest. A single fixed footrest may be adequate for a person of average height; however, the same configuration for a shorter- or taller-than-average person may be completely unreachable or may force the torso and legs into an uncomfortable bent position.

Another disadvantage of conventional inflatable kayaks is their inability to haul a significant amount of cargo. This is particularly problematic for someone planning to hike from an easily accessible starting location to a remote destination, and then return to the starting location via kayaking. In this scenario, the recreationist must carry all his/her hiking and camping gear on the kayak. Because conventional kayaks are not equipped to carry this amount of cargo, the kayaker must carry the gear in a backpack while operating the kayak. Wearing such a loaded backpack while kayaking increases the risk of the kayak overturning due to the raised center of gravity of the floating unit (i.e., kayak, operator, and cargo).

SUMMARY OF INVENTION

Accordingly, one aspect of the present invention is directed to a sit-on-top kayak comprising an inflatable hull, a seat, and a plurality of inflatable footrests incrementally spaced from the seat.

Another aspect of the present invention concerns an inflatable watercraft comprising an inflatable hull and a plurality of spaced-apart footrests. The hull includes an inflatable main body and an inflatable center section substantially surrounded by the main body. The center section includes a lower seat support member, a first recessed opening, and a second recessed opening. The lower seat support member, first recessed opening, and second recessed opening are spaced from one another. The footrests include a first set of footrests disposed in the first recessed opening and a second set of footrests disposed in the second recessed opening.

In still another aspect, the present invention relates to an inflatable watercraft including an inflatable hull and an inflatable seat. The inflatable hull includes a front and a rear portion. The inflatable seat is positioned generally between the front and rear portions. The front and rear portion include respective recessed front and rear cargo compartments.

In yet another aspect, the present invention is directed to an inflatable sit-on-top kayak having an inflatable hull, a seat, and a plurality of inflatable footrests. The inflatable hull includes a front portion and a rear portion. The seat is disposed generally between the front and rear portions. The inflatable footrests are disposed generally between the seat and the front portion. One of the front and rear portions defines a recessed cargo compartment.

The kayak of the present invention provides a number of advantages over other kayaks known in the art. For example, the kayak of the present invention accommodates operators of different heights. Further, the kayak of the present invention is configured to hold a significant amount of cargo without substantially raising the center of gravity of the combined kayak/operator/cargo unit.

These and additional features and advantages will be set forth in the detailed description which follows, and in part will be readily apparent to those skilled in the art from that description or recognized by practicing the invention as described herein.

It is to be understood that both the foregoing general description and the following detailed description are merely exemplary of the invention, and are intended to provide an overview or framework for understanding the nature and character of the invention as it is claimed. The accompanying drawings are included to provide further understanding of the invention, illustrate various embodiments of the invention, and together with the description serve to explain the principles and operation of the invention.

BRIEF DESCRIPTION OF DRAWINGS

Embodiments of the present invention are described in detail below with reference to the attached drawing figures, wherein.

DETAILED DESCRIPTION

Figure 1:
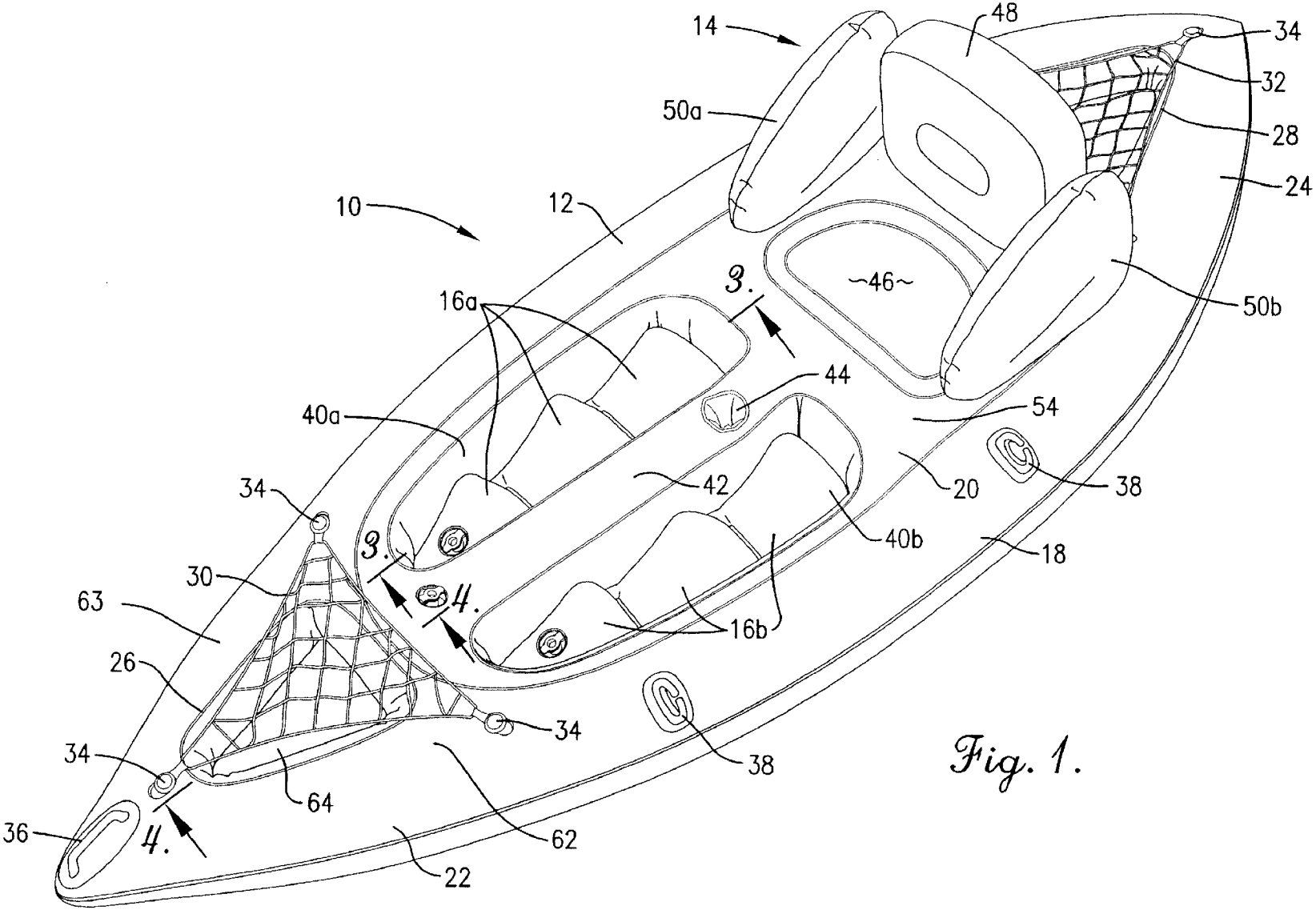
FIG. 1 is an isometric view showing the top of an inflatable sit-on-top kayak constructed in accordance with the principles of the present invention.

Referring initially to FIG. 1, an inflatable sit-on-upon kayak 10 is illustrated as generally including an inflatable hull 12, an inflatable seat 14, and first and second sets of inflatable footrests 16*a,b*. As used herein, the term "sit-on-top kayak" denotes a kayak that is configured so that the operator of the kayak sits on top of the kayak with his/her legs being exposed, as opposed to a sit-inside kayak where the legs of the operator are covered. Hull 12, seat 14, and footrests 16*a,b* are preferably formed of one or more sheets of a flexible, durable, air-impermeable material. Preferably, hull 12, seat 14, and footrests 16*a,b* are formed of the same type of material. The material of construction is preferably a fabric-reinforced flexible PVC, although any other suitable synthetic rubber or plastic may be used (e.g., polyethylene). When a plurality of sheets of material are used to construct kayak 10, the sheets can be coupled to one another by any conventional method which results in the formation of an air-tight seam at the junction of the sheets. Heat welding is one acceptable method for creating such an air-tight seam.

Inflatable hull 12 of kayak 10 includes an inflatable main body 18 and an inflatable center section 20. It is preferred for main body 18 to substantially surround center section 20. It is also preferred for main body 18 and center section 20 to be formed of separate bladders so that main body 18 and center section 20 can be separately inflated and deflated. Each bladder of kayak 10 is equipped with its own inflation valve of suitable configuration.

Main body 18 of hull 12 includes a front portion 22 and a rear portion 24. Hull 12 is elongated along an axis of elongation which extends from the tip of front portion 22 to the tip of rear portion 24. Front portion 24 defines a recessed front cargo compartment 26 while rear portion 24 defines a recessed rear cargo compartment 28. Front and rear cargo covers/nets 30,32 are releasably coupled to front and rear portions 22,24 of main body 18 via a plurality of releasable fasteners 34. Front and rear cargo nets 32,34 cover at least a portion of front and rear cargo compartments 26,28. A handle 36 is preferably permanently coupled to front portion 22 and facilitates manual manipulation of kayak 10. In addition, a pair of oar holders 38 can be permanently coupled to main body 18 for holding an oar (not shown) when the oar is not in use.

Center section 20 of hull 12 is disposed generally between front and rear portions 22,24 of main body 18. Center section 20 defines first and second recessed openings 40*a,b*. First set of footrests 16*a* is received in first recessed opening 40*a*, while second set of footrests 16*b* is received in second recessed opening 40*b*. Recessed openings 40*a,b* are spaced from one another in a direction that is substantially perpendicular to the direction of extension of the axis of elongation of hull 12. Recessed openings 40*a,b* are spaced from seat 14 in a direction that is substantially parallel to the direction of extension of the axis of elongation of hull 12. Recessed openings 40*a,b* are elongated in a direction that is substantially parallel to the direction of extension of the axis of elongation of hull 12. Preferably, recessed openings 40*a,b* have a length in a range from about 12 to about 28 inches and a width in the range of from about 3 to about 12 inches. Most preferably, recessed openings 40*a,b* have a length in the range of from 18 to 36 inches and a width in the range of from 4 to 8 inches. Recessed openings 40*a,b* are separated from one another by a dividing wall 42 of center section 20. A beverage-holding compartment 44 is preferably defined in dividing wall 42.

Center section 20 includes a recessed lower seat support member 46, which defines a bottom portion of seat 14. Recessed lower seat support member 46 provides a slightly recessed surface upon which the operator of kayak 10 can sit. Seat 14 includes an inflatable back support 48 and a pair of inflatable side supports 50*a,b*. Back and side supports 48,50 are preferably interconnected to form a common inflatable bladder. Back support 48 and side supports 50*a,b* are rigidly coupled to center section 20 of hull 12 and extend generally upwardly therefrom. Back support 48 and side supports 50*a,b* are preferably rigidly coupled to one another, with back support 48 extending generally between side supports 50*a,b*. Back support 48 and side supports 50*a,b* cooperate to form a generally U-shaped configuration that surrounds lower seat support member 46 on three sides and is open towards footrests 16*a,b*. Thus, when the operator of kayak 10 sits on recessed lower seat support member 46 and braces his/her feet against footrests 16*a,b*, back support 48 inhibits rearward movement of the operator, while side supports 50*a,b* inhibit lateral movement of the operator.

Figure 2:
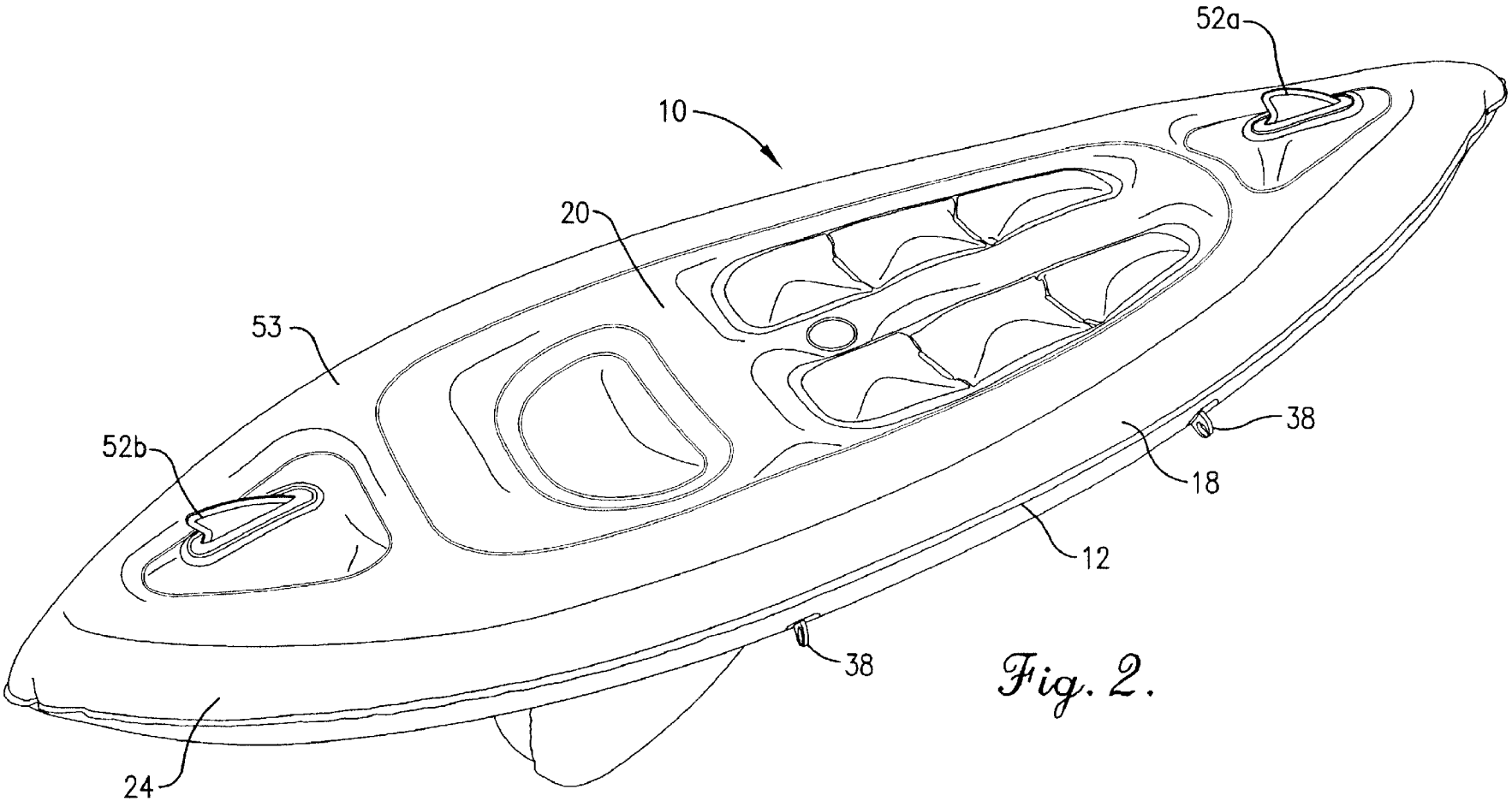
FIG. 2 is an isometric view showing the bottom of the inflatable sit-on-top kayak illustrated in FIG. 1.

Referring to FIG. 2, the bottom of kayak 10 is preferably equipped with front and rear fins 52*a,b* that are permanently coupled to hull 12 underneath the front and rear cargo compartments. It is preferred for the bottom of hull 12 to be formed of a single sheet 53 of durable material.

Figure 3:
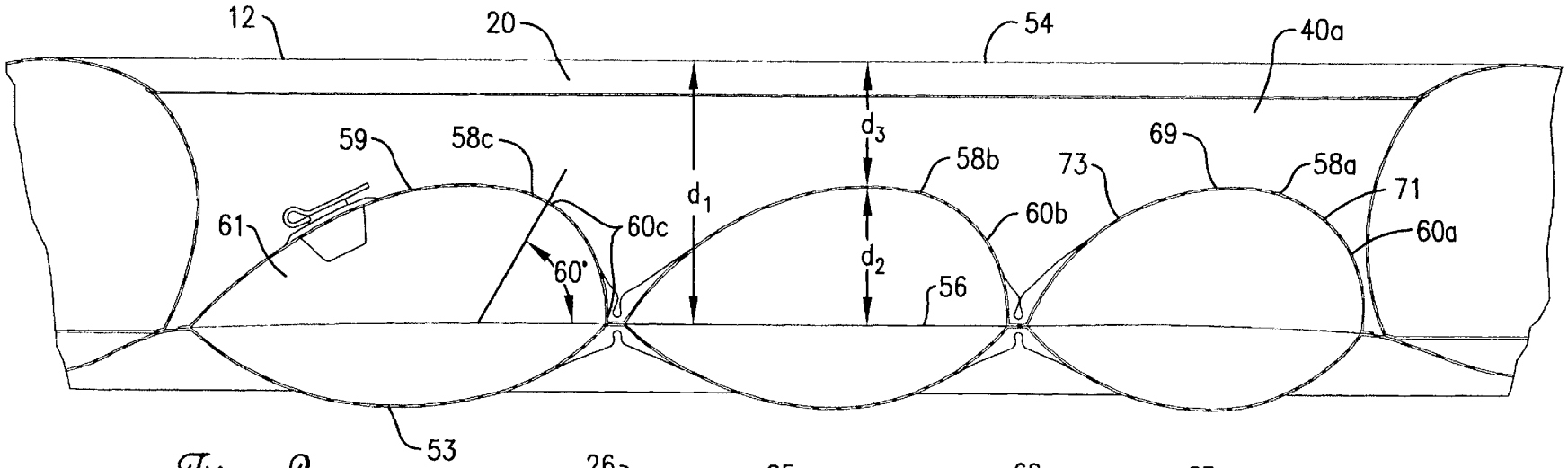
FIG. 3 is an enlarged partial sectional side view taken along line 3—3 in FIG. 1, particularly illustrating the configuration of a plurality of recessed multi-position footrests.

Referring to FIG. 3, center section 20 of hull 12 presents an upper surface 54 that defines the top of center section 20. Center section 20 preferably includes a generally horizontally-extending floor 56 in each recessed opening 40*a,b*. Floor 56 defines the bottom of recessed openings 40*a,b*. Thus, the depth of each recessed opening 40*a,b* is defined by the minimum vertical distance ($d_1$) between upper surface 54 and floor 56. It is preferred for the depth ($d_1$) of each recess opening 40*a,b* to be at least about 2 inches. More preferably the depth ($d_1$) of each recessed opening 40*a,b* is in the range of from about 3 to about 24 inches, most preferably in the range of from 4 to 12 inches. In a preferred embodiment of the present invention, floor 56 is the top surface of bottom sheet 53 (shown in FIGS. 2 and 3).

As shown in FIG. 3, each individual footrest 58 of first and second sets of footrests 16*a,b* extend upwardly from floor 56 to a maximum height ($d_2$). It is preferred for the maximum height ($d_2$) of each individual footrest 58 to be at least about 2 inches. More preferably, the maximum height ($d_2$) of each individual footrest 58 is in the range of from about 2.5 to about 12 inches, most preferably in the range of from 3 to 6 inches. Each individual footrest 58 is preferably recessed relative to upper surface 54 of center section 20 by a minimum depth ($d_3$) of at least about 1 inch. More preferably, each individual footrest 58 is recessed by a minimum depth ($d_3$) in the range of from about 1.5 to about 18 inches, most preferably in the range of from 2 to 6 inches.

Referring to FIGS. 1 and 3, it is preferred for each recessed opening 40*a,b* to receive at least 2 individual footrests 58. More preferably, recessed opening 40*a,b* receives 2 to 6 individual footrest 58. Most preferably, each recessed opening 40*a,b* receives 3 individual footrest 58. It is also preferred for individual footrests 58 of the first set of footrests 16*a* to be an inflatable common bladder which is separate from the inflatable bladder forming the second set of footrests 16*b*. Each individual footrest 58 is preferably formed of an inverted V-shaped or U-shaped top wall 59 that is sealingly coupled (e.g., by heat welding) to bottom sheet 53 along spaced-apart seams. It is further preferred, for each individual footrest 58 to include a pair of spaced-apart sidewalls 61 extending along and sealingly interconnecting top wall 59 and bottom sheet 53.

Footrests 58 are preferably incrementally spaced from seat 14 of kayak 10. This incremental spacing of footrests 58 allows for kayak 10 to accommodate operators of various sizes. Top wall 59 of each individual footrest 58 presents a rear-facing foot-contact surface 60 that faces generally towards seat 14. As shown in FIG. 3, foot contact surfaces 60 will not typically be defined by a flat surface due to the inflatable nature of footrests 58. Thus, as used herein, "foot-contact surface" shall denote a surface portion of a footrest that faces generally towards the seat and whose normal vector extends at an angle of zero to 60 degrees from horizontal. For example, FIG. 3 shows that foot contact surface 60*c* of footrest 58*c* includes the rear facing surface area of footrest 58*c* that is bounded at its lower edge by floor 56 and at its upper edge by an imaginary line representing the location where the normal vector of the foot-rest surface forms a 60 degree angle relative to floor 56. Each footrest 58 includes a crest 69 which defines an uppermost point of the footrest 58. In a preferred embodiment, each footrest 58 has an asymmetrical configuration (e.g., a teardrop shape) that presents a severely sloping portion 71 located on one side of crest 69 and a moderately sloped portion 73 (having a slope which is less severe than severely sloping portion 71) located on the other side of crest 69. Preferably, severely sloping portion 71 faces generally towards seat 14 and defines foot-contact surface 60. However, in an alternate embodiment of the present invention, the orientation of footrests 58 can be reversed so that moderately sloped portion 73 faces generally towards seat 14 and defines foot-contact surface 60.

Each foot-contact surface 60 should be configured to provide effective support/bracing for the foot of the kayak operator. Preferably, each foot-contact surface 60 is at least about 2 inches wide and at least about 2 inches high. More preferably, each foot-contact surface 60 has a width in the range of from about 3 to about 12 inches and a height in the range of from about 2.5 to about 12 inches, most preferably a width in the range of from 4 to 8 inches and a height in the range of from 3 to 8 inches. Each foot-contact surface 60 preferably presents a surface area of at least about 4 square inches. More preferably, the surface area of each foot-contact surface 60 is in the range of from about 6 to about 24 square inches, most preferably in the range of from 8 to 16 square inches. Foot contact surfaces 60 are spaced from one another in a direction that is substantially parallel to the direction of extension of the axis of elongation of hull 12. Preferably, foot contact surfaces 60 are spaced from one another on about 3 to about 18 inch centers, more preferably about 5 to about 15 inch centers, and most preferably 7 to 12 inch centers.

Figure 4:
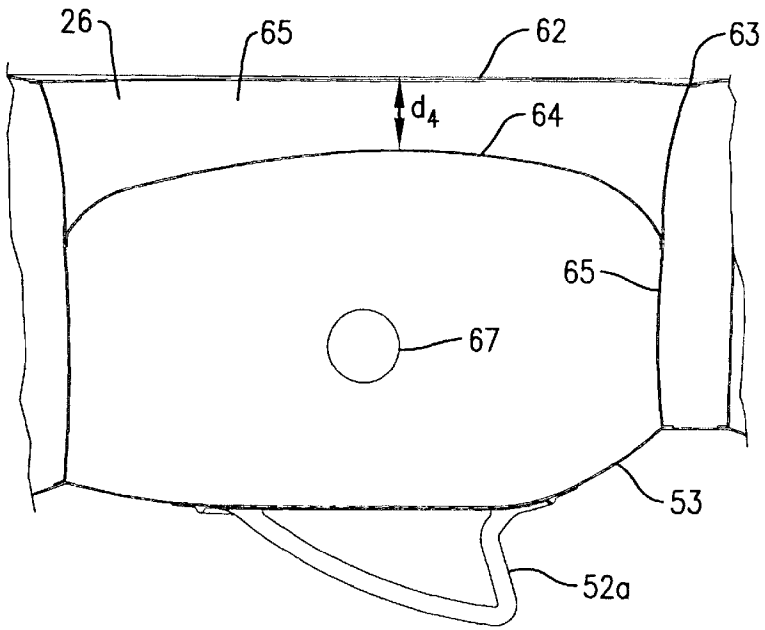
FIG. 4 is an enlarged partial sectional side view taken along line 4—4 in FIG. 1, particularly illustrating the configuration of a recessed front cargo compartment.
Figure 5:
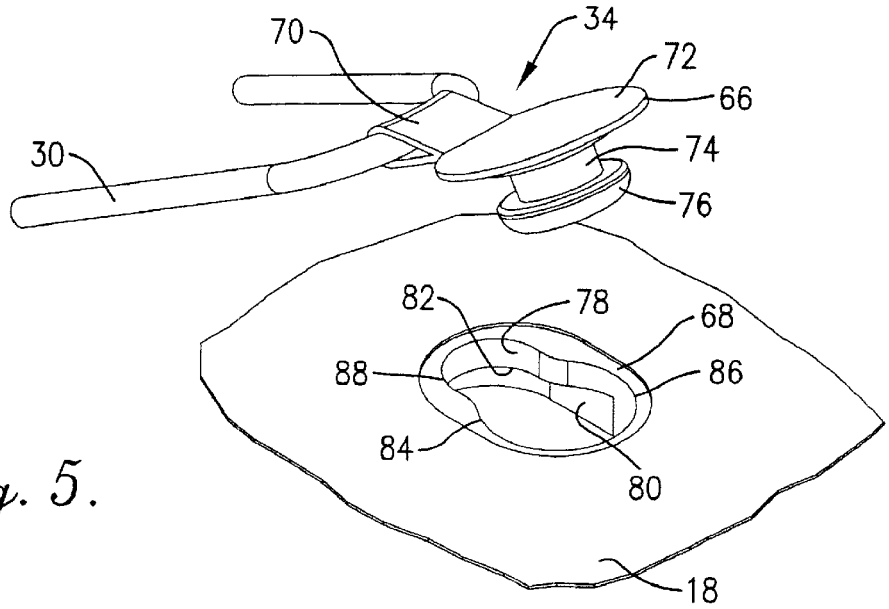
FIG. 5 is an enlarged isometric view of a releasable fastener used to releasably couple a cargo net to the main body of the kayak, particularly illustrating the fastener in a decoupled position.
Figure 6:
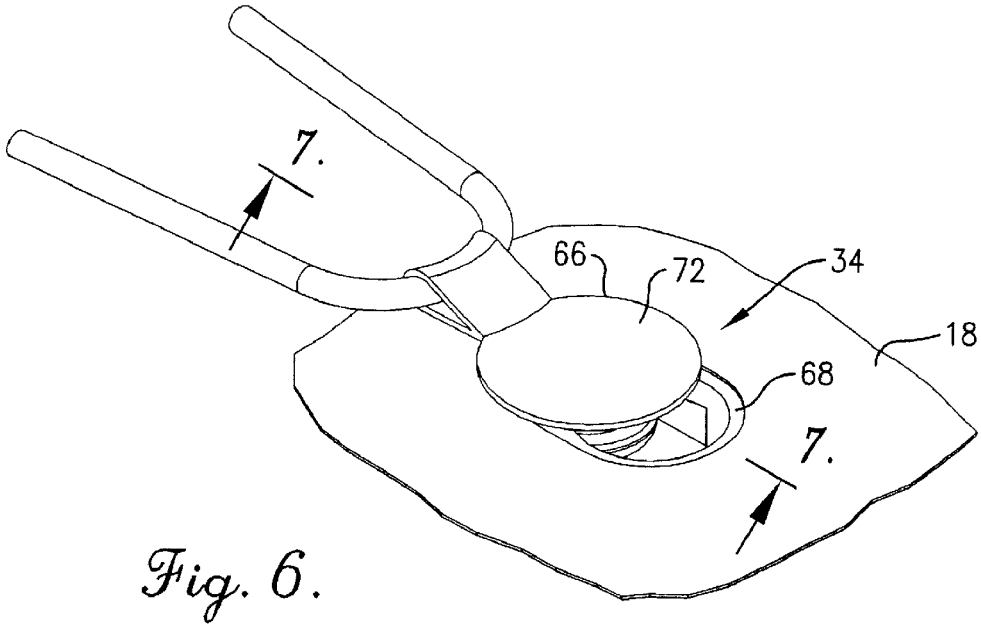
FIG. 6 is an enlarged isometric view of the releasable fastener shown in FIG. 5, particularly illustrating the fastener in a coupled position.

Referring to FIGS. 1 and 4, front portion 22 of main body 18 includes a top sheet 63. Top sheet 63 presents an upper surface 62 that defines the top of front portion 22. Front portion 22 includes a front compartment based member 64 that defines the bottom of front cargo compartment 26 and a front compartment sidewall 65 that defines the sides of front cargo compartment 26. Front compartment sidewall 65 is sealingly coupled to and extends between top sheet 63 and bottom sheet 53. The perimeter of front compartment base member 64 is sealingly coupled to sidewall 64 at a location between top and bottom sheets 63,53. It is preferred for front compartment base member 64 to be recessed relative to upper surface 62 by a minimum depth ($d_4$) of at least about 0.5 inches. More preferably, front compartment base member 64 is recessed relative to upper surface 62 by a minimum depth ($d_4$) in the range of from about 0.75 to about 12 inches, most preferably in the range of from 1 to 6 inches. It is preferred for the internal volume defined within front cargo compartment to be at least about 20 cubic inches. More preferably, the internal volume of recessed front cargo compartment 26 is in the range of from about 50 to about 500 cubic inches, most preferably in the range of from 75 to 150 cubic inches. Sidewall 65 preferably defines an opening 67 that allows air to pass therethrough so that the space defined between front compartment base member 64 and bottom sheet 53 is maintained at the same pressure as the rest of main body 18. Rear cargo compartment 28 preferably has substantially the same configuration as front cargo compartment 26.

Referring to FIGS. 1 and 5–7, cargo nets 30,32, which cover front and rear cargo compartments 26,28, are releasably coupled to front and rear portions 22,24 of main body 18 via releasable fasteners 34. Each releasable fastener 34 includes a male connector member 66 and a female connector member 68. Male connector member 66 is permanently coupled to cargo net 30 via a loop 70. Female connector member 68 is permanently coupled to main body 18 via heat welding or other suitable means. Male connector member includes a base 72, a shaft 74, and a head 76. Shaft 74 extends from the bottom of base 72, while head 76 is positioned on the distal end of shaft 74. Female connector member 68 includes a broad upper wall 78, a narrow lower wall 80, and a ledge 82 defined between upper and lower walls 78,80. Upper wall 78 defines a contoured slot 84 that includes a wide portion 86 and a narrow portion 88.

Figure 7:
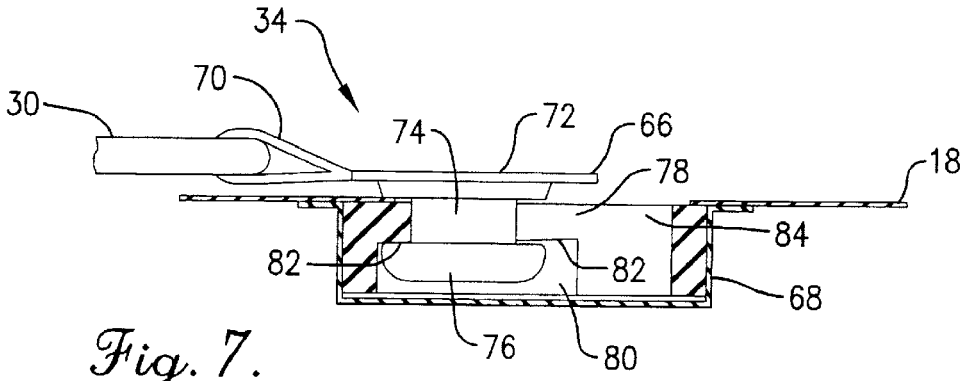
FIG. 7 is an enlarged partial sectional side view taken along line 7—7 in FIG. 6, particularly illustrating the fastener in the coupled position.

In operation, when releasable fastener 34 is shifted from the decoupled position (shown in FIG. 5) to the coupled position (shown in FIGS. 6 and 7), shaft 74 and head 76 of male connector member 66 are first inserted into wide portion 86 of contoured slot 84 until base 72 of male connector member 66 contacts female connector member 68. Male connector member 66 can then be shifted relative to female connector member 68 in a manner which forces shaft 74 into narrow portion 88 of contoured slot 84. As shown in FIG. 7, when shaft 74 is received in narrow portion 88 of contoured slot 84, ledge 82 contacts head 76 of male connector member 66 and prevents male connector member 66 from pulling out of female connector member 68. To decouple male and female connector members 66,68, shaft 74 is simply slid from narrow portion 88 of contoured slot 84 into wide portion 86 of contoured slot 86, and male connector member 66 is removed from female connector member 68. It is noted that the fasteners 34 are similar to those disclosed in U.S. Pat. No. 6,568,012, which is assigned of record to the assignee of the present invention and is hereby incorporated by reference.

Figure 8:
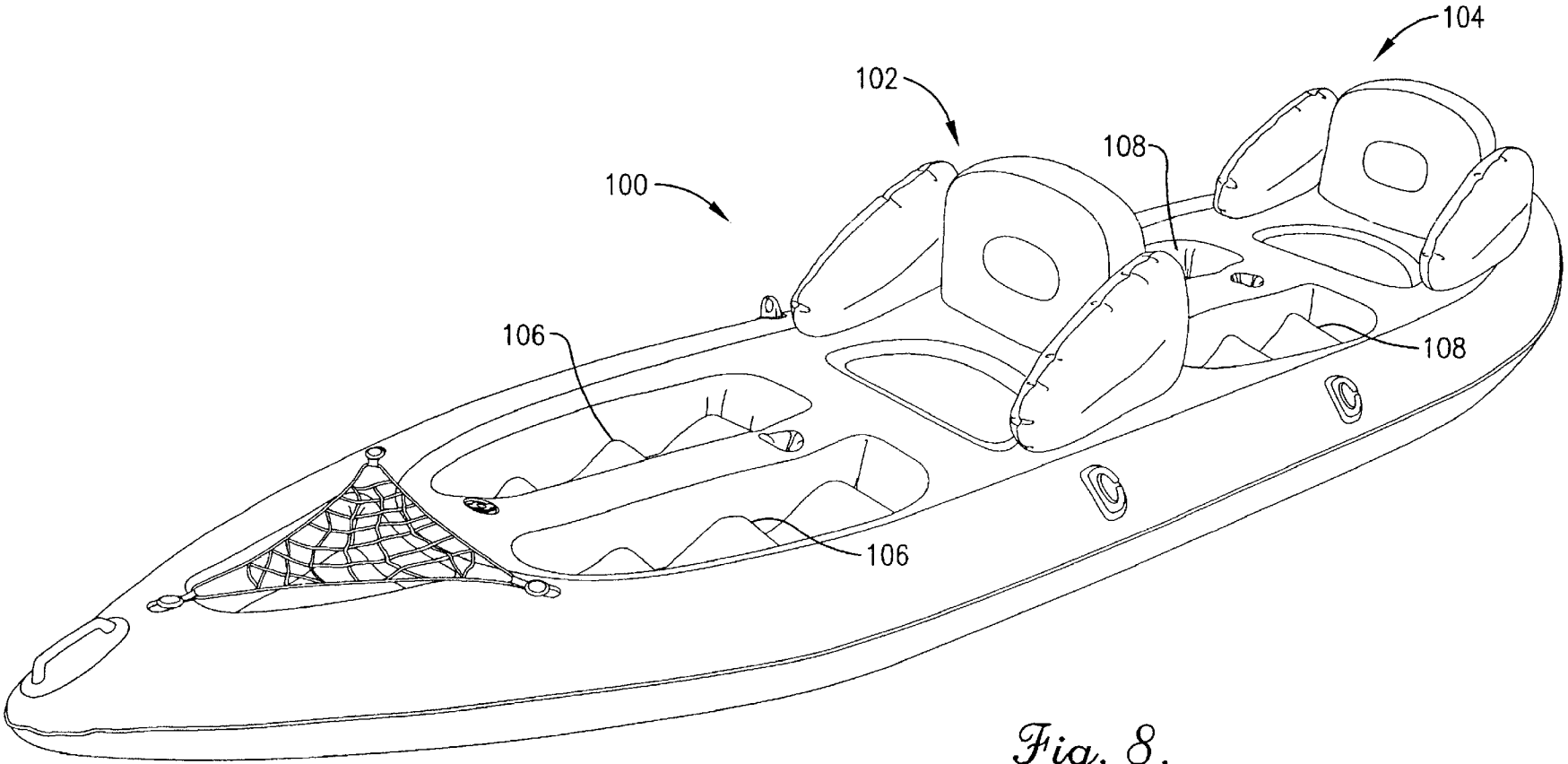
FIG. 8 is an isometric view showing the top of a two-passenger inflatable sit-on-top kayak constructed in accordance with the principles of the present invention.

Referring now to FIG. 8, in an alternative embodiment of the present invention, a two-person sit-on-top kayak 100 is provided. Two-person kayak 100 includes front and rear seats 102, 104, as well as front and rear sets of footrests 106, 108. The configuration of kayak 100 shown in FIG. 8 does not include a rear cargo compartment due to overall length considerations; however, a rear recessed cargo compartment could be provided behind rear seat 104 if desired. The configuration of the hull, seats, and footrests of two-person kayak 100 (shown in FIG. 8) are preferably substantially the same as the one-person kayak 10 (shown in FIGS. 1–7).

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

What is claimed is:

1. A sit-on-top kayak comprising:

an inflatable hull;

a seat; and a plurality of inflatable footrests incrementally spaced from the seat.

2. The sit-on-top kayak of claim 1, said plurality of footrests being recessed relative to the inflatable hull.

3. The sit-on-top kayak of claim 1, said inflatable hull defining first and second spaced-apart recessed openings, said plurality of footrests being disposed in the recessed openings.

4. The sit-on-top kayak of claim 3, said plurality of footrests including a first set of the footrests disposed in the first recessed opening and a second set of the footrests disposed in the second recessed opening, said first and second sets of footrests including more than one footrest each.

5. The sit-on-top kayak of claim 4, said first and second sets of footrests having separate inflatable bladders.

6. The sit-on-top kayak f claim 4, said inflation hull being elongated along an axis of elongation, said first and second recessed openings being spaced from one another in a direction which is substantially perpendicular to the direction of extension of the axis of elongation.

7. The sit-on-top kayak of claim 6, said recessed openings being elongated in a direction which is substantially parallel to the direction of extension of the axis of elongation.

8. The sit-on-top kayak of claim 4, each of said footrests presenting a respective foot-contact surface facing generally towards the seat, each of said foot-contact surfaces having a width in the range of from about 3 to about 12 inches and a height in the range of from about 2.5 to about 12 inches.

9. The sit-on-top kayak of claim 8, each of said footrests including a crest representing the uppermost point on the footrest, each of said footrests presenting a severely sloped portion and a moderately sloped portion, said severely sloped portion and said moderately sloped portion being located on generally opposite sides of the crest, said severely sloped portion presenting the foot-contact surface.

10. The sit-on-tap kayak of claim 8, said foot-contact surfaces of the first set of footrests being spaced from one another on about 3 to about 18 inch centers, said foot-contact surfaces of the second set of footrests being spaced from one another on about 3 to about 18 inch centers, each of said foot-contact surfaces having a surface area in the range of from about 6 to about 24 square inches.

11. The sit-on-top kayak of claim 1, said inflatable hull including an inflatable main body and a inflatable center section, said center section being at least partially surrounded by the main body, said center section presenting an upper surface, said footrests being recessed at least 1 inch below the upper surface.

12. The sit-on-top kayak of claim 11, said center portion including a lower seat support member, said lower seat support member defining a bottom portion of the seat, said lower seat support member being recessed relative to the upper surface.

13. The sit-on-top kayak of claim 1, said inflatable hull defining a front recessed cargo compartment, said inflatable hull defining a rear recessed cargo compartment, said seat being disposed generally between the front and rear recessed cargo compartments.

14. The sit-on-top kayak of claim 13; and a front cargo cover releasably coupled to the hull and configured to cover at least a portion of the front recessed cargo compartment; and a rear cargo cover releasably coupled to the hull and configured to cover at least a portion of the rear recessed cargo compartment.

15. The sit-on-top kayak of claim 1, said inflatable hull including a recessed lower seat support member, said lower seat support member defining a bottom portion of the seat.

16. The sit-on-top kayak of claim 15, said seat including an inflatable back support coupled to the inflatable hull, said seat including a pair of spaced-apart inflatable side supports coupled to the inflatable hull and the inflatable back support.

17. The sit-on-top kayak of claim 16, said lower seat support member being disposed generally between the inflatable side supports, said inflatable back support extending generally between the inflatable side supports, said lower seat support member being disposed generally between the inflatable back support and the inflatable footrests.

18. An inflatable watercraft comprising:

an inflatable hull elongated along an axis of elongation; and a plurality of spaced-apart footrests, said hull including an inflatable main body and an inflatable center section substantially surrounded by the main body, said center section including a lower seat support member, a first recessed opening, and a second recessed opening, said lower seat support member, said first recessed opening, and said second recessed opening being spaced from one another, said plurality of footrests including a first set of footrests disposed in the first recessed opening and a second set of footrests disposed in the second recessed opening.

19. The inflatable watercraft of claim 18, said first and second recessed openings being elongated in a direction substantially parallel to the direction of extension of the axis of elongation.

20. The inflatable watercraft of claim 18, said footrests of the first set of footrests being spaced from one another in a direction substantially parallel to the direction of extension of the axis of elongation, said footrests of the second set of footrests being spaced from one another in a direction substantially parallel to the direction of extension of the axis of elongation.

21. The inflatable watercraft of claim 20, said center section including first and second recessed floors defining the bottom of the first and second recessed openings respectively, each of said footrests of the first and second sets of footrests extending at least about 2 inches above the first and second recessed floors, respectively.

22. The inflatable watercraft of claim 21, said center section presenting an upper surface, said first and second recessed floors being recessed at least about 2 inches below the upper surface.

23. The inflatable watercraft of claim 22, each of said footrests presenting a respective foot-contact surface facing generally towards the lower seat support member, said foot-contact surfaces having a width of at least about 2 inches and a height of at least about 2 inches.

24. The inflatable watercraft of claim 23, said foot-contact surfaces of the first set of footrests being spaced from one another on about 3 to about 18 inch centers, said foot-contact surfaces of the second set of footrests being spaced from one another on about 3 to about 18 inches centers.

25. The inflatable watercraft of claim 23, said first and second recessed floors being recessed about 3 to about 24 inches below the upper surface, each of said footrests of the first and second sets of footrests extending about 2.5 to about 12 inches above the first and second recessed floors, respectively, said foot-contact surfaces having a width of about 3 to about 12 inches and a height of about 2.5 to about 12 inches, said foot-contact surfaces of the first set of footrests being spaced from one another on about 5 to about 15 inch centers, said foot-contact surfaces of the second set of footrests being spaced from one another on about 5 to about 15 inch centers.

26. The inflatable watercraft of claim 18, said inflatable hull defining a front recessed cargo compartment, said inflatable hull defining a rear recessed cargo compartment, said footrests being disposed generally between the front and rear recessed cargo compartments.

27. The inflatable watercraft of claim 26; and a front cargo cover releasably coupled to the inflatable hull and configured to cover at least a portion of the front recessed cargo compartment; and a rear cargo cover releasably coupled to the inflatable hull and configured to cover at least a portion of the rear recessed cargo compartment.

28. An inflatable watercraft comprising:

an inflatable hull including a front portion and a rear portion; and an inflatable sear positioned generally between the front and rear portions and arranged so that an operator of the inflatable watercraft sits in the seat with the operator's legs being exposed on a top of the inflatable hull, said front portion including a recessed front cargo compartment, said rear portion including a recessed rear cargo compartment.

29. The inflatable watercraft of claim 28; and a front cargo cover releasably coupled to the front portion and covering at least a portion of the front cargo compartment; and a rear cargo cover releasably coupled to the rear portion and covering at least a portion of the rear cargo compartment.

30. The inflatable watercraft of claim 29, said front and rear cargo covers being cargo nets.

31. The inflatable watercraft of claim 28, said front and rear cargo compartments each defining an internal volume of at least about 20 cubic inches.

32. The inflatable watercraft of claim 28, said front and rear cargo compartments each defining an internal volume in the range of from about 50 to about 500 cubic inches.

33. An inflatable watercraft comprising:

an inflatable hull including a front portion and a rear portion; and an inflatable seat positioned generally between the front and rear portions, said front portion including recessed front cargo compartment, said rear portion including a recessed rear cargo compartment, said front portion presenting a front upper 3 surface and a front compartment base surface, said rear portion presenting a rear upper surface and a rear compartment base surface, said front and rear compartment base surfaces defining the bottom of the front and rear cargo compartments, respectively, said front and rear compartment base surfaces being recessed at least about 0.5 inches below the front and rear upper surfaces, respectively.

34. The inflatable watercraft of claim 33, said front and rear compartment base surfaces being recessed about 0.75 to about 12 inches below the front and rear upper surfaces, respectively.

35. The inflatable watercraft of claim 33, said front upper surface and said front compartment base surface being defined along substantially parallel planes, said rear upper surface and said rear compartment base surface being defined along substantially parallel planes.

36. The inflatable watercraft of claim 28; and a plurality of inflatable footrests disposed generally between the seat and the front portion.

37. The inflatable watercraft of claim 36, said footrests being incrementally spaced from the seat.

38. The inflatable watercraft of claim 37, said plurality of footrests including a first set of footrests and a second set of footrests, said first and second sets of footrests including at least 2 footrests each, said first and second sets of footrests being laterally spaced from one another.

39. The inflatable watercraft of claim 38, said watercraft being a sit-on-top kayak.

40. An inflatable sit-on-top kayak comprising:

an inflatable hull including a front portion and a rear portion;

a seat disposed generally between the front and rear portions; and a plurality of inflatable footrests disposed generally between the seat and the front portion, one of said front and rear portions defining a first recessed cargo compartment.

41. The inflatable kayak of claim 40, said first cargo compartment defining an internal volume of at least about 20 cubic inches.

42. The inflatable sit-on-top kayak of claim 40, the other of said front and rear portions defining a second recessed cargo compartment.

43. The inflatable kayak of claim 42; and a front cargo cover releasably coupled to the front portion and covering at least a portion of the first cargo compartment; and a rear cargo cover releasably coupled to the rear portion and covering at least a portion of the second cargo compartment.

44. The inflatable kayak of claim 40, said footrests being incrementally spaced from the seat.

45. The inflatable kayak of claim 44, said inflatable hull defining a pair of spaced-apart recessed openings, each of said recessed openings receiving at least 2 of the footrests.

46. The inflatable kayak of claim 40, said inflatable hull including a lower seat support member defining a bottom portion of the seat, said seat including an inflatable back support coupled to the hull, said seat including a pair of spaced-apart inflatable side supports coupled to the hull and the back support, said lower seat support member being disposed generally between the side supports, said back support extending generally between the side supports.

* * * * *